US006312348B1

(12) United States Patent
Sandell

(10) Patent No.: US 6,312,348 B1
(45) Date of Patent: Nov. 6, 2001

(54) PLAYING FIELD WITH EQUIPMENT FOR A FOOTBALL-LIKE GAME

(76) Inventor: Timo Aulis Sandell, Kauppakaari 13 A 42, FIN-04200 Kerava (FI)

( * ) Notice: Subject to any disclaimer, the term of this patent is extended or adjusted under 35 U.S.C. 154(b) by 0 days.

(21) Appl. No.: 09/214,974

(22) PCT Filed: Jul. 15, 1997

(86) PCT No.: PCT/FI97/00447

§ 371 Date: Jan. 15, 1999

§ 102(e) Date: Jan. 15, 1999

(87) PCT Pub. No.: WO98/02214

PCT Pub. Date: Jan. 22, 1998

(30) Foreign Application Priority Data

Jul. 16, 1996 (FI) ..... 962867

(51) Int. Cl.[7] ..... A63B 67/00

(52) U.S. Cl. ..... 473/415; 473/471; 473/476; 473/446; 473/478; 273/108; 273/400

(58) Field of Search ..... 473/415, 478–479, 473/470, 471, 438, 446, 469, 473, FOR 128, 476; 273/400, 118 R, 108 R, 123 R, 247, 259, 277, 108.1, 126 R

(56) References Cited

U.S. PATENT DOCUMENTS

| | | | | |
|---|---|---|---|---|
| 3,580,578 | * | 5/1971 | McCarthy | 473/471 |
| 3,746,340 | | 7/1973 | Torres et al. . | |
| 4,585,235 | * | 4/1986 | Williams | 273/355 |
| 4,911,443 | * | 3/1990 | Foster | 473/470 |
| 5,110,127 | * | 5/1992 | Potter | 273/108.5 |
| 5,207,433 | | 5/1993 | Moore . | |
| 5,242,164 | * | 9/1993 | Nicoll | 273/108.5 |

FOREIGN PATENT DOCUMENTS

| | | |
|---|---|---|
| WO 86/03420 | 6/1986 | (WO) . |
| WO 94/07572 | 4/1994 | (WO) . |

* cited by examiner

*Primary Examiner*—Jeanette Chapman
*Assistant Examiner*—Mitra Aryanpour
(74) *Attorney, Agent, or Firm*—Klauber & Jackson

(57) ABSTRACT

A playing field for playing where the field includes marked sidelines, goal lines and cross-lines at a distance from the goal lines. The playing field includes a total of four goal structures, rather than the conventional two goal structures and thus there are two goal structures located along each goal line spaced from each other along that goal line. The overall soccer field complies with the international regulations governing the dimensions of the field and of the goal structures, however, a new and different game with enhanced excitement is possible with the use of the additional goal structure located along each goal line.

1 Claim, 1 Drawing Sheet

PLAYING FIELD WITH EQUIPMENT FOR A FOOTBALL-LIKE GAME

Figure 1:
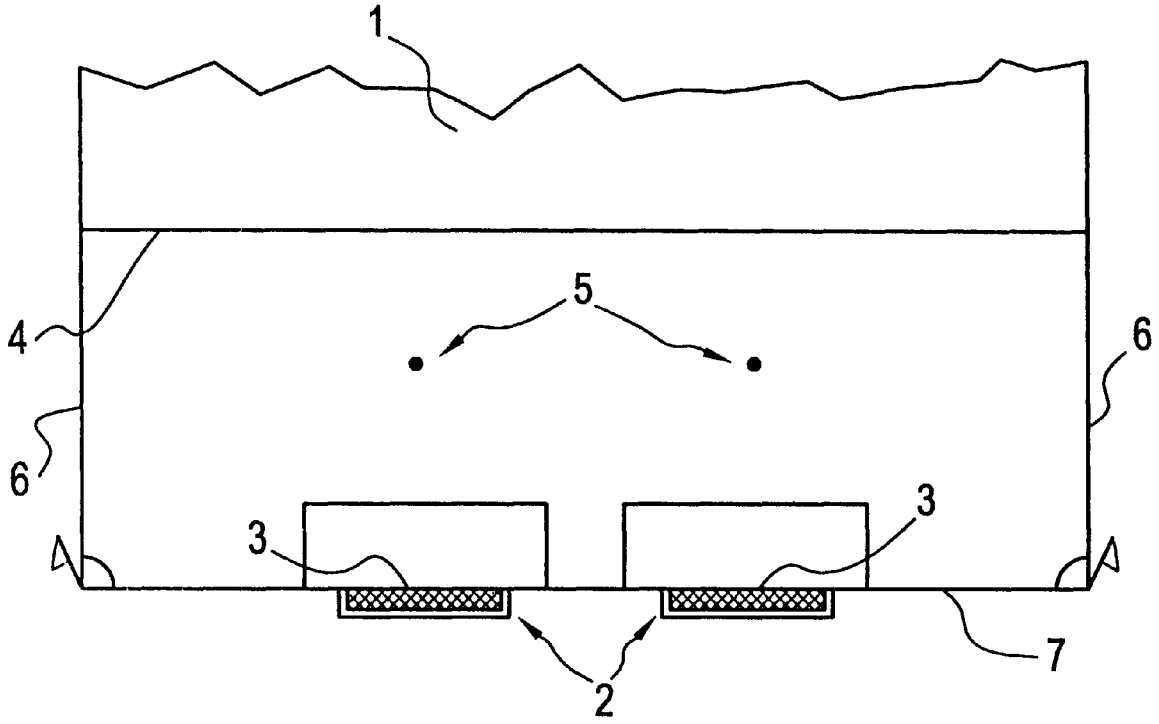

The present invention relates to a playing field with its equipment for a game like soccer, said playing field including marked sidelines, goal lines, and cross-lines at a distance from the goal lines, and said equipment including at least one goal structure on each goal line.

In the prior known traditional football or soccer field, each end is provided with a single goal structure set on the goal line. The goal structure defines an area which is bordered by the goal line, the team playing on the opposite half-field attempting to deliver the playing object across said goal line within the area defined by the goal structure. In many instances, the creation of goals and scoring chances is precluded due to a defensive style of play on the part of the defending team and a technically more skillful team is forced to settle for a final score which may be unfair in view of the events on the field. In a number of tournaments it has been necessary to decide the winner by means of a penalty shoot-out, the result of which is not always consistent with the match events during regular playing time. When football or soccer is played in a traditional playing field on a single goal, the loose ball situations, especially set pieces, create rush situations in front of the goal and players do not have enough space for ball control. Tight contact situations add to the injury risks that players are exposed to. The game may also be flat as an event, due to the lack of goal-scoring opportunities.

An object of the invention is to provide an improved playing field with its equipment, whereby it is possible to create more playing space in goal-scoring situations, the number of scored goals increasing and the game becoming more interesting to spectators.

This object is achieved by means of a playing field and its equipment according to the invention, whose characterizing features are set forth in the annexed claim 1.

The non-independent disclose preferred embodiments of the invention.

In addition to the invention being applicable to an internationally standardized playing field for the game of association football or soccer, the playing field having corresponding dimensions can be designed as a scale model, i.e. in the form of a mechanically or electrically operated playing board. The playing field of the invention can also be designed to be playable in a graphic form by means of a game set, a computer, or some other device.

The invention will now be described in more detail with reference made to the accompanying drawing, which illustrates one end section and its equipment included in a playing field of the invention.

The FIGURE shows the end section of a four-goal soccer field 1. The field is marked with side- or touch-lines 6, goal lines 7, and cross-lines 4 which are spaced from the goal lines and serve as a line for the penalty area. Each goal line 7 is provided with exactly two separate goal structures 2 spaced from each other in the direction of the goal line 7. In a preferred case, the goal structures 2 have mid-points 3 whose distance from each other is about ⅓ of the total length of the goal line 7. The goal structures 2 are set symmetrically on either side of the lengthwise mid-line of the playing field. The goal structures 2 have dimensions which are substantially equal to those of a football goal consistent with the internationally approved regulations.

On a playing field of the invention, the offensive team can select either one of the opponent's goals 2 as its target; goals scored in either goal are equal to each other. This adds to the use of a playing pitch in lateral direction, whereby the penalty line 4 may extend across the field all the way to the sidelines 6. The game can be played principally the same way as traditional football or soccer by using a football with internationally regulated measurements.

The essential feature is that the goals 2 are set on the goal line side by side and at a short distance from each other. Other than that, the sites and mutual distance of the goals may vary, provided that the goals are located on the goal line. When using a playing field of the invention, it is natural that both goals be guarded by their own goalkeeper. The number of penalty spots 5 two, one in front of each goal positioned as agreed in football rules.

In terms of setting up a playing field of the invention and its equipment, it is of course possible to depart to some extent from the measurements of a traditional football field and its goal structures. The point is that two separate goal structures are used to create space for building the game in lateral direction, which increases the number of scored goals and makes the game more eventful also for spectators.

What is claimed is:

1. a playing field for a soccer ball game, said playing field (1) including marked sidelines (6), goal lines (7), and cross-lines (4) at a distance from the goal lines, which serve as a line for the penalty area;

wherein each one of said goal lines (7) is provided with exactly two separate goal structures (2) spaced apart from each other in the direction of the goal line (7), and wherein a total number of goal structures is four;

the playing field has dimensions and boundaries which substantially comply with those of a regulation soccer field, with the exception that said cross-lines extend from one sideline to the other;

the goal structures (2) have dimension that are substantially equal to those of a regulation soccer goal, and wherein the goal structures have mid-points (3) whose distance from each other is about ⅓ of the total length of the goal line (7), the goal structure (2) being set symmetrically on either side of the lengthwise mid-line of the playing field;

wherein each of the goal structures (2) is guarded by a separate goal keeper and the number of penalty spots (5) are two on each side, one in front of each goal structure;

whereby crating more playing space in goal-scoring situations allows the number of scored goals to increase and the game to become more interesting to spectators.

* * * * *